US005826875A

United States Patent [19]

Kardel

[11] Patent Number: 5,826,875

[45] Date of Patent: Oct. 27, 1998

[54] WIPEOUT BOARD GAME

[76] Inventor: Edward L. Kardel, 19-B Pond Ave., Newport, R.I. 02840

[21] Appl. No.: 788,193

[22] Filed: Jan. 24, 1997

[51] Int. Cl.[6] ..... A63F 3/00

[52] U.S. Cl. ..... 273/243

[58] Field of Search ..... 273/243, 248, 273/249, 269, 246, 258, 259, 268

[56] References Cited

U.S. PATENT DOCUMENTS

| | | | |
|---|---|---|---|
| 648,961 | 5/1900 | Hurd | 273/248 |
| 2,343,812 | 3/1944 | Sikora | 273/248 |
| 3,549,150 | 12/1970 | Weeks | 273/269 |
| 3,642,285 | 2/1972 | Impastato | 273/243 |
| 4,340,231 | 7/1982 | Cammarata | 273/243 |
| 4,449,710 | 5/1984 | Davis | 273/249 |
| 5,449,179 | 9/1995 | Hefferan | 273/269 |

*Primary Examiner*—William M. Pierce

[57] ABSTRACT

A game apparatus having a plurality of game boards, one for each player, with each said game board having a starting line at a bottom and a finish line at a top thereof and a plurality of spaces extending from said starting line to said finish line forming a plurality of columns with each space in each column being numbered sequentially such that a first space of each column begins with a different sequential number and with each game board further having a safe zone designated below the finish line. Each player attempts to move a plurality of playing pieces up his game board according to the roll of a die. A plurality of poker chips are used to pay a penalty for any and all players having a playing piece on a numbered space equal to a number according to a roll of a die by an opposing player. The first player to move all of his playing pieces to the finish line is the winner and receives a reward.

2 Claims, 1 Drawing Sheet

1-PLAYING BOARD
2-START LINE
3-COLUMNS
4-SAFE ZONE
5-FINISH LINE
6-BINGO CHIP
7-POKER CHIP
8-DICE
9-BOWL
10-NUMBERS IN COLUMN
11-SPELLING "WIPEOUT"
12-SPACES IN COLUMN

WIPEOUT BOARD GAME

BACKGROUND—FIELD OF INVENTION

This invention relates to games of the general type concerned with amusement and educational devices.

BACKGROUND—DESCRIPTION OF PRIOR ART

There are many games that utilize numerically marked segmented paths upon which a player moves his playing piece as indicated by the roll of the dice. For example the Sikora patent U.S. Pat. No. 2,343,812 which utilizes a single game board and in which a player must roll a specific number on the dice to move and again must roll a specific number to enter his objective zone to end the game. The Impasto patent U.S. Pat. No. 3,642,285 in which a player must his playing piece to a corressponding number on his playing board as is rolled on the dice. The Weeks patent U.S. Pat. No. 3,549,150 shows a numbered playing board with color coding and a word across the top of the game board. In this game a player must roll one numbered die and one colored die to move a playing piece to a corresponding square on the game board. The game ends when a player completes any row across his playing board. The Hefferan patent U.S. Pat. No. 5,449,179 is a game based on the "BINGO" game format utilizing holiday stikers in place of numbers. The Cammarata patent U.S. Pat. No. 4,340,231 is a word game where letters are variously weighted to provide a score for each word formed. The Hurd patent U.S. Pat. No. 648,961 shows a game-board with concentric circles and ramps 1 leading to a goal. In this game players attempt to reach their goal by random spins of a dial, any player landing on a space occupied by an oppossing players playing piece the latter will be removed from the board to the starting space to begin again. The Davis patent U.S. Pat. No. 4,449,710 has a color coded game-board and a color coded die it utilizes a game book that utilizes present life situations and problems which a player must answer with a correct response to achieve a reward.

OBJECTS AND ADVANTAGES

Acordingly several objects and advantages of my invention are to provide a game of the above character which I term "WIPEOUT" that is highly interesting imaginative and amusing and at the same time sufficently simple in the method of play to be within the grasp of small children.

The invention has another object in providing a game that is simple in construction and inexpensive to manufacture needing no supplementary paraphernalia other than a suitably marked die and a few simple game pieces.

With the above and other objects and advantages in view that will hereafter appear the nature of the invention will be more clearly understood by reference to the following detailed description the appended claims and illustrated in the accompanying drawings.

DESCRIPTION OF PREFERED EMBODIMENT

Figure 1:
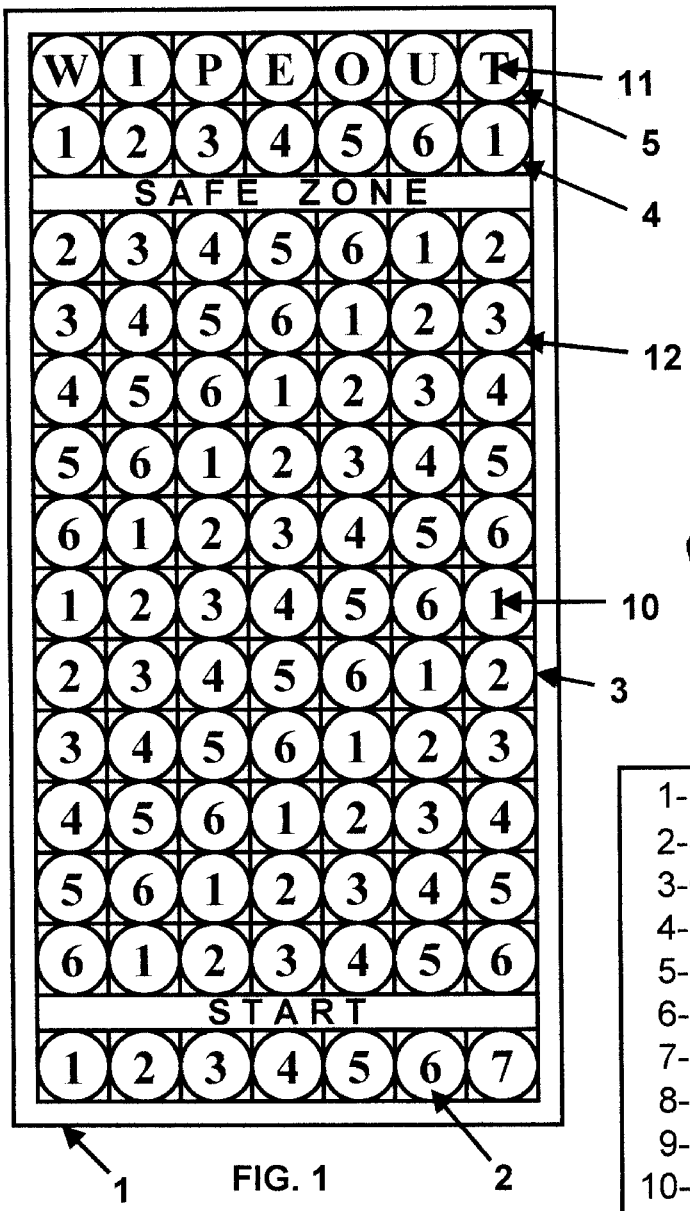
FIG. 1 is a view of a board for playing the game.
Figure 2:
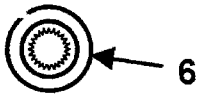
FIG. 2 illustrates a clear plastic chip to used a playing piece.
Figure 3:
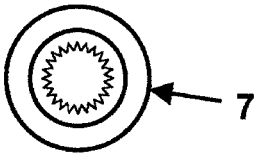
FIG. 3 Illustrates a poker chip to be used as penalty payment.
Figure 4:
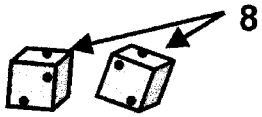
FIG. 4 Illustrates a die to be used to determine the advance of aplaying piece.
Figure 5:
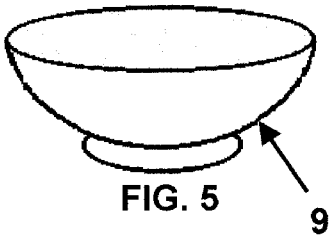
FIG. 5 Illustrates a bowl to be used to hold poker chips paid in penalty.

Refering to FIG. 1 in the drawing the playing board 1 is divided into columns 3 of alternating sequential numbers 10 with a starting line 2 a safe zone 4 and a finish line 5 comprising the spelling of the word "WIPEOUT" 11. FIG. 2 is that of a clear chip 6 to be placed on the starting line 2 and moved up the columns 3 the number of spaces 12 shown on the die 8 FIG. 4. In the drawing FIG. 3 is a poker chip 7 to be used as a penalty payment and placed in a bowl 9 that is FIG. 5.

To begin the game each player is given a playing board 1 and fifty poker chips 7 as well as seven playing pieces 6. Players align their playing pieces 6 on the starting line 2. Each player will cast the die 8 with the highest roller to go first. This player then rolls the die 8 and moves any one of his playing pieces 6 up any of the columns 3 he chooses the number of spaces 12 shown on the die 8. The next player rolls the die 8 and again moves the playing piece 6 of his choice up the column 3 of his choice. Should a player roll a number on the die 8 that corrospnds to a number 10 on the board 1 that an oppossing player has a playing piece 6 upon the latter will move the playing piece 6 back to the starting line 2 and place a poker chip 7 into the bowl 9 as a penalty. If a player has a playing piece 6 in the safe zone 4 and the number 10 he is on is rolled by an opponent the playing piece 6 will remain in the safe zone 4. To move to the finish line 5 unless in the safe zone 4 a player must roll the correct number of spaces 12 needed to move to the finish line 5. Should the number on the die 8 be higher than the number of spaces 12 needed to move to the finish line 5 the player must move another playing piece 6 onto or up an open column 3 unless this is the last playing piece 6 on the open board, then that player loses a turn . Any player having a playing piece 6 in the safe zone 4 must roll a number on the die 8 that corresponds to the number 10 the players playing piece 6 is on in order to move to the finish line 5. The game ends when the first player to cover the word "WIPEOUT" with all of his playing pieces 6 on the finish line 5. This player also receives all poker chips 7 that have been paid in penalty.

What is claimed is:

1. A game apparatus comprising:

a plurality of game boards, one for each player, with each said game board having a starting line at a bottom and a finish line at a top thereof and a plurality of spaces extending from said starting line to said finish line forming a plurality of columns with each space in each column being numbered sequentially such that a first space of each column begins with a different sequential number and with each game board further having a safe zone designated below the finish line;

a plurality of playing pieces for each player equal to the number of columns on a players game board and a die to control the movement of the playing pieces wherein the playing pieces are to be moved vertically up the game board according to a roll of the die;

a plurality of poker chips; and wherein a first player to move all of his playing pieces to the finish line is the winner and receives a reward and the poker chips are used to pay a penalty for any and all players having a playing piece on a numbered space equal to a number according to a roll of a die by an opposing player.

2. A game apparatus according to claim 6 wherein the finish line is a row of spaces each designated with a letter to spell the word "WIPEOUT".

* * * * *